US005779180A

United States Patent [19]

Smedt et al.

[11] Patent Number: 5,779,180

[45] Date of Patent: Jul. 14, 1998

[54] WINDER FOR USE WITH BAG-MAKING MACHINE

[75] Inventors: Eric De Smedt, Opwijk; Wim Verbeiren, Lede, both of Belgium

[73] Assignee: FMC Corporation, Chicago, Ill.

[21] Appl. No.: 730,857

[22] Filed: Oct. 18, 1996

[51] Int. Cl.[6] ..... B65H 19/30

[52] U.S. Cl. ..... 242/528; 242/533.6

[58] Field of Search ..... 242/528, 533.6, 242/533.5, 533.4

[56] References Cited

U.S. PATENT DOCUMENTS

| | | | |
|---|---|---|---|
| 2,995,314 | 8/1961 | Nystrand | 242/533.6 |
| 3,881,665 | 5/1975 | Leloux | 242/533.6 |
| 3,930,620 | 1/1976 | Taitel | 242/533.6 |
| 4,069,986 | 1/1978 | Carlsen | 242/533.6 |
| 4,642,084 | 2/1987 | Gietman | 493/190 |
| 4,667,890 | 5/1987 | Gietman . | |
| 4,695,005 | 9/1987 | Gietman . | |
| 4,729,521 | 3/1988 | Kubo et al. . | |
| 4,883,233 | 11/1989 | Saukkonen et al. . | |
| 5,161,793 | 11/1992 | Lotto et al. | 271/182 |
| 5,197,727 | 3/1993 | Lotto et al. | 271/183 |
| 5,318,237 | 6/1994 | Lotto et al. . | |
| 5,337,968 | 8/1994 | De Bin et al. | 242/521 |
| 5,350,928 | 9/1994 | Hatchell et al. | 250/548 |
| 5,362,013 | 11/1994 | Gietman et al. | 242/521 |
| 5,377,929 | 1/1995 | Gietman et al. | 242/521 |
| 5,390,875 | 2/1995 | Gietman et al. | 242/521 |
| 5,453,070 | 9/1995 | Moody | 493/288 |
| 5,531,660 | 7/1996 | Biese et al. | 493/243 |
| 5,570,878 | 11/1996 | Lotto et al. | 271/203 |
| 5,588,644 | 12/1996 | Lotto et al. | 271/183 |

FOREIGN PATENT DOCUMENTS 0568253 3/1993 European Pat. Off. .

5338883 12/1993 Japan .

OTHER PUBLICATIONS

CMD Corporation, *Cordless/Core Winders Brochure* Appleton, WI, Oct., 1993.

FMC Corporation, *M–450 Continuous Motion Winder Product Brochure*, Green Bay, WI, Jul. 1996.

FMC Corporation, *M–350 Winder Product Brochure*, Green Bay, WI, 1992.

*Primary Examiner*—John M. Jillions

*Attorney, Agent, or Firm*—Rockey, Milnamow & Katz, Ltd.

[57] ABSTRACT

In a winder for winding webs from a bag-making machine into rolls, a winding turret mounts four winding spindles, each having a web-winding portion and a pulley-mounting portion, which mounts a conjointly rotatable pulley and an independently rotatable pulley. A first timing belt and a second timing belt are arranged to be independently driven. The winding turret is indexable so that, in any indexed position, a first timing belt interengages the conjointly rotatable pulley mounted on the given winding spindle and interengages the independently rotatable pulley mounted on the next winding spindle and a second timing belt interengages the independently rotatable pulley mounted on the given winding spindle and interengages the conjointly rotatable pulley mounted on the next winding spindle. The rotational speeds of a motor driving a given winding spindle, whichever is being used to complete winding of a roll, and the rotational speed of a motor driving a web conveyor are measured. The motor driving the same winding spindle is adjusted so as to maintain a generally constant winding tension on a web being wound. A pair of infeeding rollers and a pair of separating rollers are operated so as to apply a generally constant winding tension to a web, except during intervals during which the surface speed of the separating rollers exceeds the surface speed of the infeeding rollers so as to separate the web at cross perforations.

9 Claims, 2 Drawing Sheets

WINDER FOR USE WITH BAG-MAKING MACHINE

TECHNICAL FIELD OF THE INVENTION

This invention pertains to a winder for winding continuous webs or interleaved web segments, as from a bag-making machine, into rolls. The winder incorporates improved mechanisms for operating multiple winding spindles mounted operatively on an indexable winding turret, improved mechanisms for controlling web tension, and improved mechanisms for separating a continuous web into separate webs, which may be then interleaved, at cross perforations in the continuous web.

BACKGROUND OF THE INVENTION

Commonly, a winder is used for winding continuous webs or interleaved web segments, as from a bag-making machine, into rolls. The continuous webs or interleaved web segments are plastic bags, such as trash bags, or any similar or dissimilar products that may be similarly wound into rolls. Commonly, a continuous web is provided with cross perforations, along which the continuous web is broken to form separate web segments, which are interleaved before winding.

Such a winder having a web segment-interleaving capability is exemplified in Lotto et al. U.S. Pat. No. 5,197,727. As disclosed therein, three winding spindles are mounted operatively on a winding turret, which is indexable through an endless series of indexed positions. Interleaved web segments are wound continuously onto a selected spindle.

In a Model No. 450 winder available commercially from FMC Corporation of Chicago, Ill., a conveyor is used to convey a continuous web or interleaved web segments to a selected one of four winding spindles mounted operatively on a winding turret, which has been indexed so that the selected spindle is located at an initial transfer position. After winding of the continuous web or interleaved web segments into a roll has been initiated on the selected spindle functioning as an initial transfer spindle in the initial transfer position, the winding turret is indexed so that the selected spindle is moved to a final wind position, at which winding of the continuous web or interleaved web segments into a roll on the selected spindle functioning as a final wind spindle in the final wind position is completed.

When located in the initial transfer position, the selected spindle functioning as an initial transfer spindle is driven by engagement with an initial transfer driving belt. When moved from the initial transfer position into the final wind position, the selected spindle is disengaged from the initial transfer driving belt. When located in the final wind position, the selected spindle functioning as a final wind spindle is driven by engagement with a final wind driving belt.

Moreover, in the Model No. 450 winder, the diameter of the roll being formed on the selected spindle is measured by a potentiometer mechanism, and the torque output of a motor driving the final wind driving belt is varied accordingly. The motor driving the final wind belt is controlled so that the torque output is generally constant.

Furthermore, in the Model No. 450 winder, a continuous web having cross perforations is fed from a first set of driven rolls that have rolling frictional contact with the continuous web between a second set of driven rolls that can be selectively moved together so as to contact the continuous web. Since the rolls of the second set are driven at a peripheral speed that is higher when compared to the peripheral speed of the rolls of the first set, the continuous web is separated into separate web segments when the rolls of the second set are moved together while cross perforations in the continuous web are passing between the rolls of the first set and the rolls of the second set.

While the Model No. 450 winder offers significant advantages over prior winders, this invention provides further improvements in such a winder, as summarized below.

SUMMARY OF THE INVENTION

In a winder according to this invention, there is no need for a winding spindle to be driven by different driving belts in an initial transfer position and in a final wind position, as in prior winders, whereby this invention avoids potential problems of poor torque control and excessive belt wear. Moreover, as compared to prior winders, a winder according to this invention provides improved means to maintain a generally constant winding tension on a continuous web or interleaved web segments being wound. Furthermore, as compared to prior winders, a winder according to this invention provides improved means for separating a continuous web into separate web segments.

According to a first aspect of this invention, a winder for winding continuous webs or interleaved web segments into rolls comprises a winding turret, which is indexable about an axis through an endless series of indexed positions. Plural winding spindles, preferably four winding spindles, are mounted operatively on the winding turret. Each winding spindle is arranged to be rotatably driven about its own axis, which is parallel to the winding turret axis. Each winding spindle has a pulley-mounting portion and a web-winding portion, which is adapted to receive a continuous web or interleaved web segments for winding into a roll.

On each winding spindle, two pulleys adapted to interengage a timing belt are mounted on the pulley-mounting portion, one such pulley being mounted thereon so as to be conjointly rotatable with such winding spindle and the other pulley being mounted thereon so as to be independently rotatable. A first timing belt interengages the conjointly rotatable pulley mounted on the pulley-mounting portion of a first winding spindle and interengages the independently rotatable pulley mounted on the pulley-mounting portion of a second winding spindle. A second timing belt interengages the conjointly rotatable pulley mounted on the pulley-mounting portion of the second winding spindle and interengages the independently rotatable pulley mounted on the pulley-mounting portion of the first winding spindle. The first and second timing belts are arranged to be independently driven.

Preferably, as mentioned above, four such winding spindles are mounted operatively on the winding turret. Preferably, moreover, the winding turret is indexable so that, in any given position among the endless series of indexed positions, the first timing belt interengages the conjointly rotatable pulley mounted on the pulley-mounting portion of a given winding spindle and interengages the independently rotatable pulley mounted on the pulley-mounting portion of the next winding spindle. Furthermore, the second timing belt interengages the independently rotatable pulley mounted on the pulley-mounting portion of the given winding spindle and interengages the conjointly rotatable pulley mounted on the pulley-mounting portion of the next winding spindle.

Preferably, the first and third winding spindle axes are diametrically opposed (cross-wise) with reference to the winding turret axis, the second and fourth winding spindle axes are diametrically opposed (cross-wise) with reference to the winding turret axis. Thus, it is preferred that the first, second, third, and fourth winding spindle axes are spaced uniformly from one another about an imaginary circular cylinder. Preferably, moreover, the respective pulleys are toothed pulleys and the respective timing belts are toothed timing belts, whereby precise torque control is achieved and belt slippage is avoided.

According to a second aspect of this invention, a winder for winding continuous webs or interleaved web segments into rolls comprises a winding spindle arranged to be rotatably driven so as to wind a continuous web or interleaved web segments and a web conveyor arranged to be linearly driven so as to convey the continuous web or interleaved web segments being wound to the winding spindle. The winder also comprises a motor arranged for driving the winding spindle at a measurable, rotational speed and a motor arranged for driving the web conveyor at a measurable, peripheral speed, together with means for measuring the rotational speed of the winding spindle and means for measuring the peripheral speed of the web conveyor. The winder further comprises means for controlling one of the motors, preferably the motor for driving the winding spindle, so as to maintain a generally constant winding tension on the continuous web or interleaved web segments being wound.

If the web conveyor comprises an endless belt deployed around a driving pulley and a driven pulley and if the motor arranged for driving the web conveyor has a shaft coupled to the driving pulley through a driving belt or otherwise, the means for measuring the peripheral speed of the web conveyor may be arranged to count revolutions per unit time of the shaft of the motor arranged therefor or of one of the driving and driven pulleys, preferably the driving pulley. The means for measuring the rotational speed of the winding spindle may be arranged to count revolutions per unit time of the winding spindle or, if the motor arranged for driving the winding spindle has a shaft coupled to the winding spindle through a timing belt or otherwise, the means for measuring the rotational speed of the winding spindle may be arranged to count revolutions per unit time of the shaft of the motor arranged therefor. The motor-controlling means noted above responds to the respective speed-measuring means.

According to a third aspect of this invention, a winder for winding a continuous web or interleaved web segments into rolls comprises a pair of infeeding rollers arranged to infeed a web having a series of cross perforations, the infeeding rollers including a driving roller and a driven roller and remaining in rolling frictional contact with the web being infed, and a pair of separating rollers arranged to receive the web from the infeeding rollers, the separating rollers including a driving roller and a driven roller and remaining in rolling frictional contact with the web except at cross perforations in the web. The winder further comprises a motor arranged for driving the driving roller of the infeeding rollers, a motor arranged for driving the driving roller of the separating rollers, and means for controlling the motors.

The motors are controlled by the controlling means so that the peripheral speeds of the driving rollers of the infeeding and separating rollers are controlled so as to apply a generally constant feeding tension on the web, except during each of a series of intervals, during which the peripheral speed of the driving roller of the separating rollers exceeds the peripheral speed of the driving roller of the separating rollers so as to apply a greatly increased tension to the web between the infeeding and separating rollers, the greatly increased tension being sufficient to separate the web into separate webs at the cross perforations.

Preferably, the motor for driving the driving roller of the infeeding rollers is a frequency-controlled motor and the motor for driving the driving roller of the separating rollers is a servo-controlled motor. Preferably, moreover, the controlling means comprises an encoder for measuring the rotational speed of the motor for driving the driving roller of the infeeding rollers and an encoder for measuring the rotational speed of the motor for driving the driving roller of the separating rollers.

These and other objects, features, and advantages of this invention are evident from the following description of a preferred embodiment of this invention, with reference to the accompanying drawings.

BRIEF DESCRIPTION OF THE DRAWINGS

In FIG. 4, certain pulleys are shown fragmentarily so as to reveal other pulleys, which would be otherwise concealed.

DETAILED DESCRIPTION OF THE PREFERRED EMBODIMENT

Figure 1:
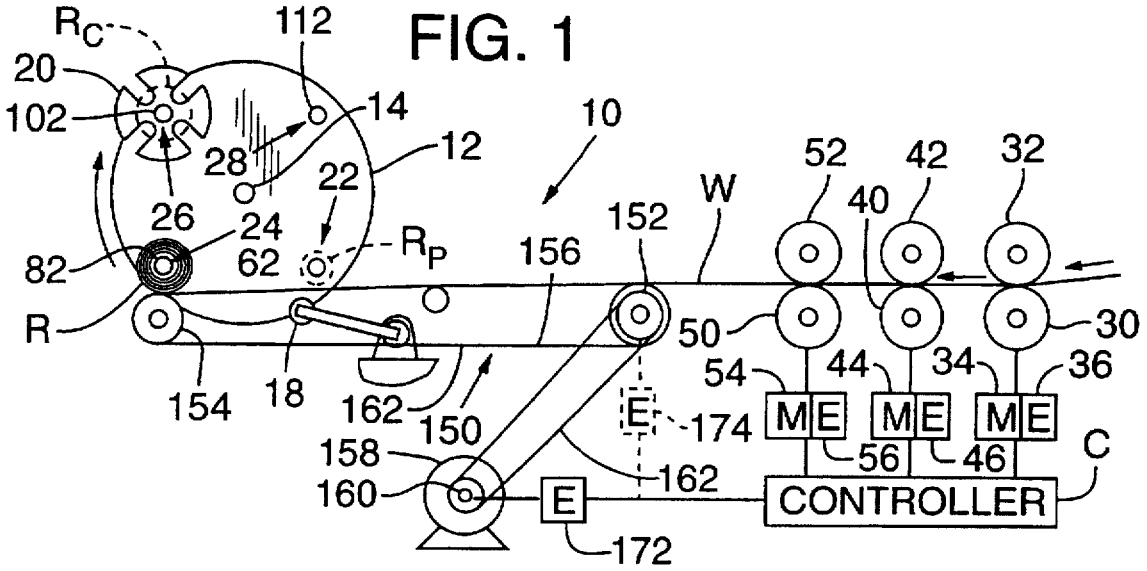
FIG. 1 is a schematic representation of a winder constituting a preferred embodiment of this invention, as used to wind a continuous web or interleaved web segments into a roll.

As shown in FIG. 1 and other views, a winder 10 for winding continuous webs or interleaved web segments into rolls constitutes a preferred embodiment of this invention. In certain respects, the winder 10 is similar to the winding an interleaving apparatus disclosed in Lotto et al. U.S. Pat. No. 5,197,727, the disclosure of which is incorporated herein by reference.

The winder 10 comprises a winding turret 12 indexable about a center shaft 14, which defines a winding turret axis, through an endless series of four indexed positions. The winder 10 also comprises four winding spindles mounted operatively on the winding turret 12. The winding spindles may be consecutively numbered for convenient reference. As shown in FIG. 1, a first winding spindle 22 is located in what may be conveniently called an initial transfer position and a second winding spindle 24 is located in what may be conveniently called a final wind position. Moreover, a third winding spindle 26 is located in what may be conveniently called a push-off position and a fourth winding spindle 28 is located in what may be conveniently called an idle spindle position.

The winding turret 12 is indexable from a first indexed position, in which it is shown in FIG. 1, into a second indexed position. Thus, the first winding spindle 22 is moved from the initial transfer position into the final wind position and the second winding spindle 24 is moved from the final wind position into the push-off position. Also, the third winding spindle 26 is moved from the push-off position into the idle spindle position and the fourth winding spindle 28 is moved from the idle spindle position into the initial transfer position. The winding turret 12 is indexable from the second indexed position into a third indexed position, in which the fourth winding spindle 28 is moved from the initial transfer position into the final wind position and so on. The winding turret 12 is indexable from the third indexed position into a fourth indexed position, in which the third winding spindle 26 is moved from the initial transfer position into the final wind position and so on, and from the fourth indexed position into the first indexed position.

A kick roller 18 and other means (not shown) outside the scope of this invention are used, in a known manner, to transfer a leading edge of a continuous web onto whichever one of the winding spindles is located in the initial transfer position, whereupon the same one of the winding spindles is driven rotatably so as to begin to wind the continuous web into a roll. A programmable controller C is programmed to control the same one of the winding spindles in the initial transfer position and in the final wind position. After a few turns, the winding turret 12 is indexed so as to move same one of the winding spindles from the initial transfer position into the final wind position, at which winding of the continuous web into a roll on the same one of the winding spindles is completed. After winding of the continuous web into a roll on the same one of the winding spindles has been completed, the winding turret 12 is indexed so as to move the same one of the winding spindles from the final wind position into the push-off position, at which a push-off palm 20 is operated to push the completed roll off the same one of the winding spindles.

In an alternative embodiment (not shown) contemplated by this invention, the position occupied by the third winding spindle 26 in FIG. 1 may be conveniently called a roll-taping position, rather than a push-off position, and the position occupied by the fourth winding spindle 28 in FIG. 1 may be conveniently called a push-off position, rather than an idle spindle position. In the alternative embodiment, a taping mechanism (not shown) outside the scope of this invention is operable to apply a tape, such as a paper tape, onto a completed roll in the rolltaping position. Moreover, a push-off palm similar to the push-off palm 20 is operable to push the completed, taped roll off the associated winding spindle in the push-off position of the alternative embodiment.

As shown in full lines in FIG. 1, a continuous web W is being wound into a roll R on the second winding spindle 24, in the final wind position. In FIG. 1, a partial roll $R_p$ comprised of a few turns is shown in broken lines on the first winding spindle 22, in the initial transfer position. Moreover, a complete roll $R_c$ is shown in broken lines on the third winding spindle 26, in the push-off position where the push-off palm 20 can push the complete roll $R_c$ off the third winding spindle 26.

As shown in FIG. 1, the continuous web W is fed to the winding turret 12 through a pair of infeed rollers, a pair of separating rollers, and a pair of transfer rollers. The infeed rollers are comprised of a driving roller 30 and a driven roller 32. The driving roller 30 is driven by a frequency-controlled, alternating current motor 34, which is coupled to the driving roller 30 and on which an encoder 36 is mounted. The encoder 36 is arranged to count revolutions per unit time for measuring the rotational speed of the motor 34. The separating rollers are comprised of a driving roller 40 and a driven roller 42. The driving roller 40 is driven by a servo-controlled, alternating current motor 44, which is coupled to the driving roller 40 and on which an encoder 46 is mounted. The encoder 46 is arranged to count revolutions per unit time for measuring the rotational speed of the motor 44. The transfer rollers are comprised of a driving roller 50 and a driven roller 52. The driving roller 50 is driven by a frequency-controlled, alternating current motor 54, which is coupled to the driving roller 50 and on which an encoder 56 is mounted for measuring the rotational speed of the motor 54. The controller C is arranged for receiving signals from the encoders 36, 46, 56 and for controlling the motors 34, 44, 54.

Figure 2:
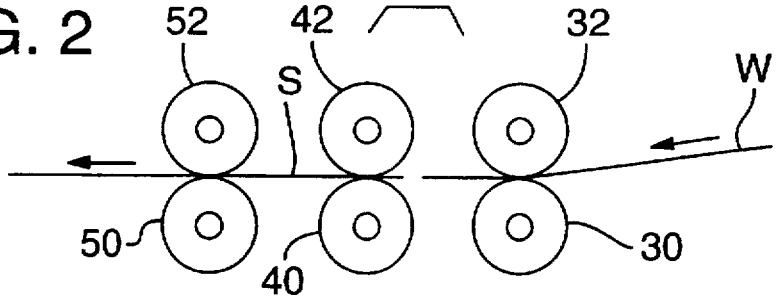
FIG. 2, on a larger scale compared to FIG. 1, is a schematic representation of certain infeed, separating, and transfer rollers shown in FIG. 1, as used to separate a continuous web into separate web segments, which may be then interleaved.
Figure 3:
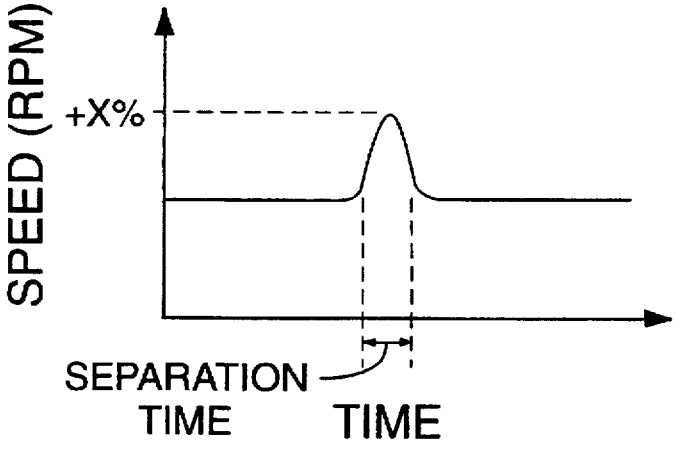
FIG. 3 is a graph of time versus rotational speed for a motor driving the separating rollers when used as shown in FIG. 2.

The controller C is programmed for controlling the motors 34, 54, so that the infeed rollers 30, 32, and the transfer rollers 50, 52, are driven at the same peripheral speeds, if a continuous web is involved, or at comparatively higher peripheral speeds for the infeed rollers 30, 32, and comparatively lower peripheral speeds for the transfer rollers 50, 52, if separate web segments are involved. The controller C is programmed for controlling the motor 44 so that the separating rollers 40, 42, are driven at peripheral speeds equal to the peripheral speeds of the infeed rollers 30, 32, except when it is desired to separate the continuous web W into a series of separate web segments S (one shown) that can be then interleaved, at cross perforations in the continuous web W, as shown in FIG. 2. The controller C is programmed for increasing the rotational speed of the motor 44 by a suitable percentage (X%) for a brief interval of separation time, as graphed in FIG. 3, when it is desired to do so. The infeed rollers 30, 32, remain in continuous rolling contact with the continuous web before its separation into separate web segments S. Except where the continuous web is separated at cross perforations, the separating rollers 40, 42, and the transfer rollers 50, 52, remain in continuous rolling contact with the series of separate web segments S.

Suitable means (not shown) outside the scope of this invention are employed to guide the series of separate web segments S between the infeed rollers 30, 32, and the separating rollers 40, 42, between the separating rollers 40, 42, and the transfer rollers 50, 52, and downstream from the transfer rollers 50, 52. As disclosed in the Lotto et al. patent noted above, suitable means (not shown) outside the scope of this invention may be then employed for interleaving the series of separated web segments S before the interleaved web segments S reach the winding turret 12.

Figure 5:
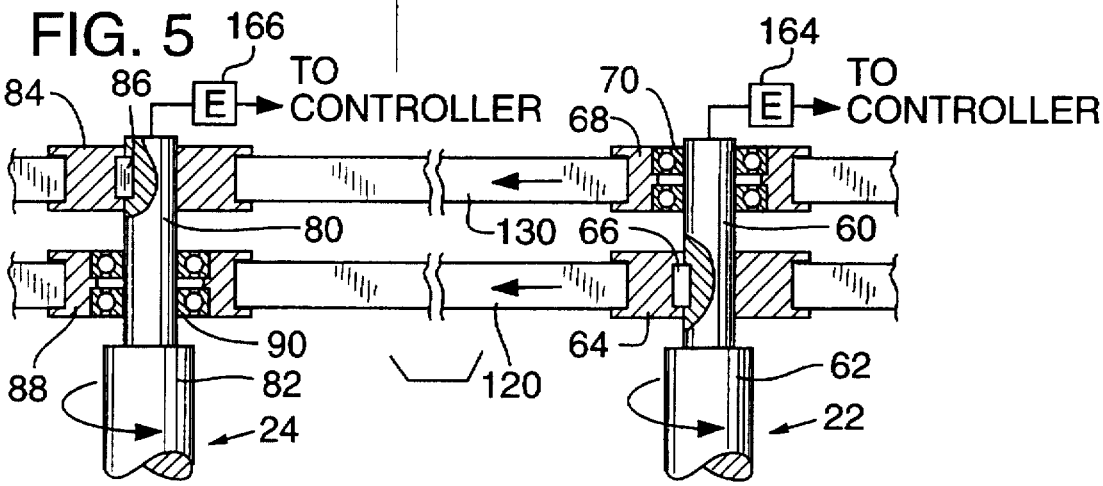
FIG. 5, on a larger scale compared to FIG. 4, is a sectional detail taken along line 5—5 of FIG. 4, in a direction indicated by arrows.

Each of the winding spindles 22, 24, 26, 28, has a pulley-mounting portion and a web-winding portion, which is adapted to receive a continuous web or interleaved web segments for winding into a roll. Thus, as shown in FIG. 5, the first winding spindle 22 has a pulley-mounting portion 60 and a web-winding portion 62. A pulley 64 is mounted on the pulley-mounting portion 60 and is keyed to the pulley-mounting portion 60, via a key 66, so as to be conjointly rotatable with the first winding spindle 22 and so as to be comparatively nearer to the web-winding portion 62. A pulley 68 is mounted on the pulley-mounting portion 60, via a pulley or ball bearing 70, so as to be independently rotatable on the first winding spindle 22 and so as to be comparatively farther from the web-winding portion 62. Also, as shown in FIG. 5, the second winding spindle 24 has a pulley-mounting portion 80 and a web-winding portion 82. A pulley 84 is mounted on the pulley-mounting portion 80 and is keyed to the pulley-mounting portion 80, via a key 86, so as to be conjointly rotatable with the second winding spindle 24 and so as to be comparatively farther from the web-mounting portion 82. A pulley 88 is mounted on the pulley-mounting portion 80, via a pulley or ball bearing 90, so as to be independently rotatable on the second winding spindle 24 and so as to be comparatively nearer to the web-mounting portion 82.

Being similar to the first winding spindle 22, the third winding spindle 26 has a pulley-mounting portion (not shown) and a web-mounting portion 102. The pulley-mounting portion of the third winding spindle 26 mounts a pulley (not shown) similar to the conjointly rotatable pulley 64 and mounted similarly so as to be conjointly rotatable with the third winding spindle 26 and so as to be comparatively nearer to the web-mounting portion 102. Moreover, the pulleymounting portion thereof mounts a independently rotatable pulley (not shown) similar to the pulley 68 and mounted similarly so as to be independently rotatable on the third winding spindle 26 and so as to be comparatively farther from the web-mounting portion 102.

Being similar to the second winding spindle 24, the fourth winding spindle 28 has a pulley-mounting portion (not shown) and a web-mounting portion 112. The pulley-mounting portion of the fourth winding spindle 28 mounts a pulley (not shown) similar to the conjointly rotatable pulley 64 and mounted similarly so as to be conjointly rotatable with the fourth winding spindle 28 and so as to be comparatively farther from the web-mounting portion 112. Moreover, the pulleymounting portion thereof mounts a pulley (not shown) similar to the independently rotatable pulley 68 and mounted similarly so as to be independently rotatable on the fourth winding spindle 28 and so as to be comparatively nearer to the webmounting portion 112.

A first timing belt 120, which is toothed, is deployed around a driving pulley 122 and several driven pulleys 124 so as to interengage with two pulleys at each indexed position of the winding turret 12. A motor 136, preferably a servo-controlled, alternating current motor, is arranged for driving the driving pulley 122, which drives the first timing belt 120. A second timing belt 130, which is toothed, is deployed around a driving pulley 132 and several driven pulleys 134 so as to interengage with two pulleys at each indexed position of the winding turret 12. A servo-controlled, alternating current motor 126 is arranged for driving the driving pulley 132, which drives the second timing belt 130.

Thus, at each indexed position of the winding turret 12, the first timing belt 120 interengages with whichever one of the pulleys mounted on the pulleymounting portion of the winding spindle located in the initial transfer position is nearer to the web-winding portion thereof and with whichever one of the pulleys mounted on the pulley-mounting portion of the winding spindle located in the final wind position is nearer to the web-winding portion thereof. Also, at each indexed position of the winding turret 12, the second timing belt 130 interengages with whichever one of the pulleys mounted on the pulley-mounting portion of the winding spindle located in the initial transfer position is farther from the webwinding portion thereof and with whichever one of the pulleys mounted on the pulley-mounting portion of the winding spindle located in the final wind position is farther from the web-winding portion thereof.

As shown in FIG. 5, the first timing belt 120 interengages with the conjointly rotatable pulley 64 mounted on the pulley-mounting portion 60 of the first winding spindle 22, in the initial transfer position, and with the independently rotatable pulley 88 mounted on the pulley-mounting portion 80 of the second winding spindle 24, in the final wind position. Moreover, the second timing belt 130 interengages with the independently rotatable pulley 68 mounted on the pulley-mounting portion 60 of the first winding spindle 22, in the initial transfer position, and with the conjointly rotatable pulley 84 mounted on the pulley-mounting portion 80 of the second winding spindle 24, in the final wind position.

Whenever a continuous web or a series of interleaved webs is wound initially into a partial roll on the web-winding portion of the winding spindle located in the initial transfer position, the winding spindle located in the initial transfer position is driven rotatably by whichever one of the timing belts is interengaged with the conjointly rotatable pulley mounted on the pulley-mounting portion of the winding spindle located in the initial transfer position. When the winding turret 12 is indexed so as to move the winding spindle having the partial roll from the initial transfer position into the final wind position, while the same winding spindle is being moved, and after the same winding spindle has been moved, the same winding spindle continues to be rotatably driven by the same one of the timing belts.

The first timing belt 120 interengaging with the conjointly rotatable pulley 64 mounted on the pulley-mounting portion 60 of the first winding spindle 22, in the initial transfer position, and with the independently rotatable pulley 88 mounted on the pulley-mounting portion 80 of the second winding spindle 24, in the final wind position, is driven by the motor 136 and drives the first winding spindle 22 rotatably in the initial transfer position while the pulley 88 rotates freely. When the winding turret 12 is indexed so as to move the first winding spindle 22 from the initial transfer position into the final wind position, while the first winding spindle 22 is being moved, and after the first winding spindle has been moved into the final wind position, the first timing belt 120 continues to drive the first winding spindle 22. Similarly, for winding of a roll on the third winding spindle 26, the first timing belt 120 is employed to drive the third winding spindle 26. Similarly, for winding of a roll on the second winding spindle 24 or on the fourth winding spindle 28, the second timing belt 130 is employed to drive the winding spindle being employed.

As shown in FIG. 1, the continuous web W or the series of interleaved web segments is conveyed to the winding turret 12 by a web conveyor 150 comprising a driving pulley 152, a driven pulley 154, an endless conveyor belt 156 deployed around the conveyor pulleys 152, 154, and a motor 158 having a drive shaft 160 coupled to the driving pulley 152 by an endless drive belt 162 for driving the web conveyor 150 at a measurable, peripheral speed. As shown in FIG. 5, an encoder 164 counting revolutions per unit time is arranged for measuring the rotational speed of the first winding spindle 22 and for sending signals to the controller C. Moreover, an encoder 166 counting revolutions per unit time is arranged for measuring the rotational speed of the second winding spindle 24 and for sending signals to the controller C. A similar encoder (not shown) is arranged for measuring the rotational speed of the third winding spindle 26 and for sending signals to the controller C. A similar encoder (not shown) is arranged for measuring the rotational speed of the fourth winding spindle 28 and for sending signals to the controller C.

Alternatively, as shown in full lines in FIG. 1, an encoder 172 counting revolutions per unit time is arranged for measuring the rotational speed of the drive shaft 160 of the motor 158 driving the web conveyor 150, as an indirect measure of the peripheral speed of the web conveyor 156, and for sending signals to the controller C. Alternatively, as shown in broken lines in FIG. 1, an encoder 174 counting revolutions per unit time is arranged for measuring the rotational speed of one of the conveyor pulleys 152, 154, preferably the driving pulley 152, as an indirect measure of the peripheral speed of the web conveyor 156, and for sending signals to the controller C.

Figure 4:
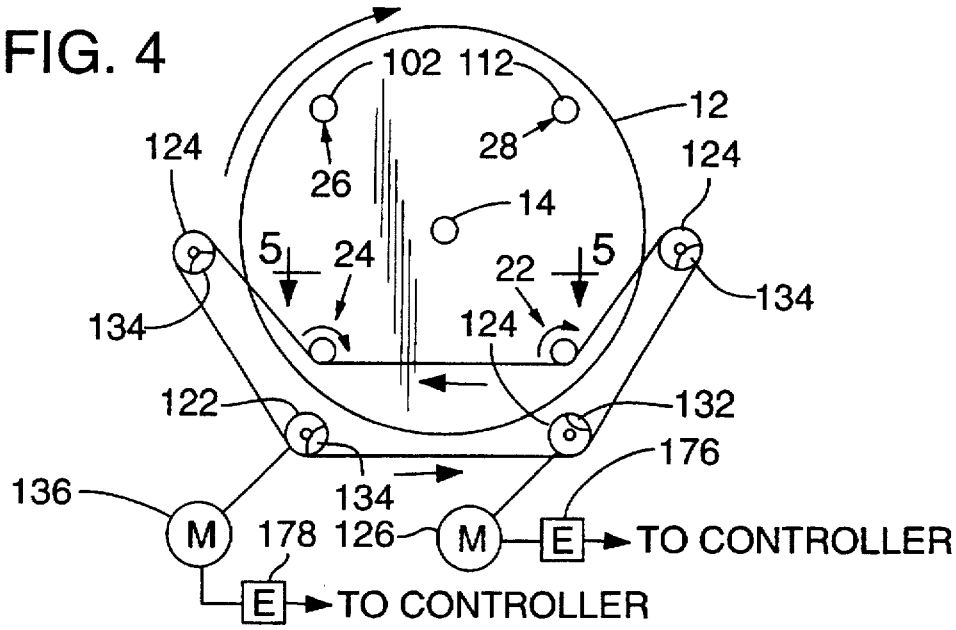
FIG. 4, on a larger scale compared to FIG. 1, is a schematic representation of a winding turret of the winder, together with mechanisms included in the winder for driving plural winding spindles mounted operatively on the winding turret.

Alternatively, as shown in FIG. 4, an encoder 178 counting revolutions per unit time is arranged for measuring the rotational speed of the motor driving the first timing belt 120, as an indirect measurement of the rotational speed of the winding spindle being driven by the first timing belt 120. Additionally, as shown in FIG. 4, an encoder 176 counting revolutions per unit time is arranged for measuring the rotational speed of the motor driving the second timing belt 130, as an indirect measurement of the rotational speed of the winding spindle being driven by the second timing belt 130.

Figure 6:
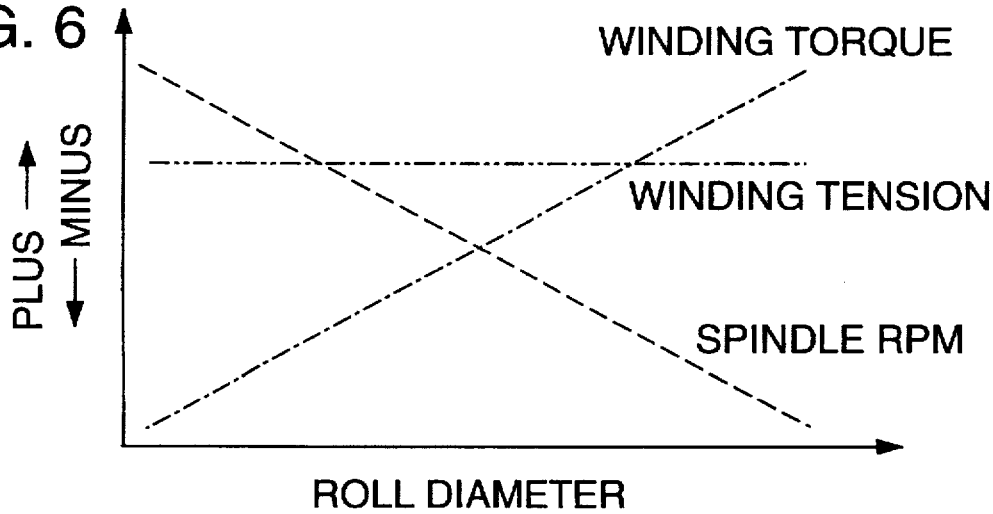
FIG. 6 is a graph of winding torque, winding tension, and spindle rotational speed (in revolutions per minute) versus roll diameter for the winder when used to wind a continuous web or interleaved web segments into a roll.

Preferably, the controller C is programmed for controlling the motor driving whichever of the timing belts is driving the winding spindle that is being employed at any given time for winding a continuous web or a series of interleaved web segments, so as to maintain a generally constant winding tension on the continuous web or on the series of interleaved web segments. The relationships among the winding torque, the winding tension, and the rotational speed of the winding spindle are shown graphically in FIG. 6. Alternatively, the controller C is programmed for controlling the motor 158 driving the web conveyor 150, so as to maintain a generally constant winding tension on the continuous web or on the series of interleaved web segments.

Various modifications may be made in the preferred embodiment described above without departing from the scope and spirit of this invention.

We claim:

1. A winder for winding continuous webs or interleaved web segments into rolls, the winder comprising (a) a winding turret indexable about a winding turret axis through an endless series of indexed positions, (b) a first winding spindle mounted operatively on the winding turret and arranged to be rotatably driven about a first winding spindle axis parallel to the winding turret axis, the first winding spindle having a pulley-mounting portion and a web-winding portion adapted to receive a continuous web or interleaved web segments for winding into a roll, (c) a pulley adapted to interengage a timing belt and mounted on the pulley-mounting portion of the first winding spindle so as to be conjointly rotatable with the first winding spindle, (d) a pulley adapted to interengage a timing belt and mounted on the pulley-mounting portion of the first winding spindle so as to be independently rotatable, (e) a second winding spindle mounted operatively on the winding turret and arranged to be rotatably driven about a second winding spindle axis parallel to the winding turret axis, the second winding spindle having a pulley-mounting portion and a web-winding portion adapted to receive a continuous web or interleaved web segments for winding into a roll, (f) a pulley adapted to interengage a timing belt and mounted on the pulley-mounting portion of the second winding spindle so as to be conjointly rotatable with the second winding spindle, (g) a pulley adapted to interengage a timing belt and mounted on the pulley-mounting portion of the second winding spindle so as to be independently rotatable, (h) a first timing belt interengaging the conjointly rotatable pulley mounted on the pulley-mounting portion of the first winding spindle and interengaging the independently rotatable pulley mounted on the pulley-mounting portion of the second winding spindle, and (i) a second timing belt interengaging the independently rotatable pulley mounted on the pulley-mounting portion of the first winding spindle and interengaging the conjointly rotatable pulley mounted on the pulley-mounting portion of the second winding spindle, (j) a first motor and a first driving pulley, said first driving pulley rotatable engaged to said first timing belt, said first motor connected to said first driving pulley to rotate said first driving pulley to circulate said first timing belt;

(k) second motor and a second driving pulley, said second driving pulley rotatable engaged to said second timing belt, said second motor connected to said second driving pulley to rotate said second driving pulley to circulate said second timing belt.

2. The winder of claim 1 further comprising (a) a third winding spindle mounted operatively on the winding turret and arranged to be rotatably driven about a third winding spindle axis parallel to the winding turret axis, the third winding spindle having a pulley-mounting portion and a web-winding portion adapted to receive a continuous web or interleaved web segments for winding into a roll, (b) a pulley adapted to interengage a timing belt and mounted on the pulley-mounting portion of the third winding spindle so as to be conjointly rotatable with the third winding spindle, (c) a pulley adapted to interengage a timing belt and mounted on the pulley-mounting portion of the third winding spindle so as to be independently rotatable, (d) a fourth winding spindle mounted operatively on the winding turret and arranged to be rotatably driven about a fourth winding spindle axis parallel to the winding turret axis, the fourth winding spindle having a pulley-mounting portion and a web-winding portion adapted to receive a continuous web or interleaved web segments for winding into a roll, (c) a pulley adapted to interengage a timing belt and mounted on the pulley-mounting portion of the fourth winding spindle so as to be conjointly rotatable with the fourth winding spindle, (d) a pulley adapted to interengage a timing belt and mounted on the pulley-mounting portion of the fourth winding spindle so as to be independently rotatable, wherein the winding turret is indexable so that, in any given position among the endless series of indexed positions, the first timing belt interengages the conjointly rotatable pulley mounted on the pulley-mounting portion of a given winding spindle from the first, second, third, and fourth winding spindles and interengages the independently rotatable pulley mounted on the pulley-mounting portion of the next winding spindle therefrom and the second timing belt interengages the independently rotatable pulley mounted on the pulley-mounting portion of the given winding spindle therefrom and interengages the conjointly rotatable pulley mounted on the pulley-mounting portion of the next winding spindle therefrom.

3. The winder of claim 2 wherein the first and third winding spindle axes are diametrically opposed with reference to the winding turret axis and wherein the second and fourth winding spindle axes are diametrically opposed with reference to the winding turret axis.

4. The winder of claim 3 wherein the first, second, third, and fourth winding spindle axes are spaced uniformly from one another about an imaginary circular cylinder.

5. The winder of claim 1 wherein the respective pulleys are toothed pulleys and wherein the respective timing belts are toothed timing belts.

6. The winder of claim 1 wherein at least one of said first and second motors comprises a servo-controlled alternating current motor.

7. The winder of claim 1 further comprising an encoder signal connected to one of said first and second motors, said encoder counting revolutions per unit time for measuring rotational speed of said one motor.

8. The winder of claim 1 further comprising a sensor and a controller, said sensor measuring rotational speed of at least one of said first and second motors, and said controller controlling rotational speed of said one of said first and second motors to maintain a substantially constant tension in said continuous web or interleaved web segments being wound on one of said first and second winding spindles.

9. The winder of claim 1 wherein said first and second motors each comprise a servo-controlled alternating current motor, and further comprising first and second encoders respectively signal connected to each of said first and second motors, said first and second encoders counting revolutions per unit time for measuring rotational speed of each of said first and second motors, and a controller, said first and second encoders signal connected to said controller, said controller signal connected to each of said first and second motors, said controller controlling the speed of said first motor to control the winding speed of said first winding spindle, said controller controlling the speed of said second motor to control the speed of said second winding spindle, said winding speeds controlled to decrease with increasing roll diameter of a continuous web or interleaved web segments on each of said first and second winding spindles.

* * * * *